US007658300B2

(12) United States Patent
Eckert et al.

(10) Patent No.: US 7,658,300 B2
(45) Date of Patent: Feb. 9, 2010

(54) CONTAINER FOR TRANSPORTING AND STORING HAZARDOUS SUBSTANCES AND METHOD FOR MAKING THE CONTAINER

(75) Inventors: Alan G. Eckert, Leetonia, OH (US); Trevor M. Rummel, Leetonia, OH (US)

(73) Assignee: Columbiana Boiler Company, LLC, Columbiana, OH (US)

( * ) Notice: Subject to any disclaimer, the term of this patent is extended or adjusted under 35 U.S.C. 154(b) by 0 days.

(21) Appl. No.: 11/745,801

(22) Filed: May 8, 2007

(65) Prior Publication Data

US 2008/0156813 A1 Jul. 3, 2008

Related U.S. Application Data

(60) Provisional application No. 60/746,820, filed on May 9, 2006.

(51) Int. Cl.
*F17C 1/00* (2006.01)

(52) U.S. Cl. ..... 220/581; 220/612; 220/623; 220/567.3

(58) Field of Classification Search ..... 220/581, 220/610, 612, 623, 567.3; 228/153
See application file for complete search history.

(56) References Cited

U.S. PATENT DOCUMENTS 518,548 A * 4/1894 Lee ..... 220/610
929,255 A * 7/1909 Singleton ..... 220/581
1,577,974 A * 3/1926 Kelley ..... 220/612
1,878,709 A * 9/1932 Kerr ..... 220/581
1,946,494 A * 2/1934 Horton ..... 220/581
2,078,546 A * 4/1937 Sebell ..... 413/1
2,290,903 A * 7/1942 Ansel ..... 220/612
2,332,454 A * 10/1943 Martin ..... 220/612
2,335,153 A * 11/1943 Lauck ..... 220/567.3
2,348,696 A * 5/1944 Schabacker ..... 156/69
2,363,990 A * 11/1944 Priebe ..... 228/205
2,387,353 A * 10/1945 Raymond ..... 220/89.2
2,401,231 A * 5/1946 Crawford ..... 220/567.3
2,480,376 A * 8/1949 Martin ..... 220/567.3
2,540,052 A * 1/1951 Martin ..... 29/458
2,547,521 A * 4/1951 Buehler ..... 117/224
2,587,840 A * 3/1952 Gruetjen ..... 220/612
2,613,015 A * 10/1952 Keating ..... 220/567.3
2,685,857 A * 8/1954 Kuhn ..... 72/370.21

(Continued)

OTHER PUBLICATIONS

Search Report and Written Opinion for corresponding PCT International Application No. PCT/US2007/068562, dated Sep. 15, 2008.

(Continued)

*Primary Examiner*—Anthony Stashick
*Assistant Examiner*—Christopher B McKinley
(74) *Attorney, Agent, or Firm*—Hahn Loeser & Parks LLP

(57) ABSTRACT

A container for transporting and storing hazardous materials such as Chlorine includes a cylindrical body having end caps. The end caps are welded to the body to form a pressure vessel. The end caps have a peripheral edge that is recessed with respect to the ends of the body to protect the weld against damage from impact. The configuration of the juxtaposed components forms a lap joint that can be affixed together by a fillet weld.

13 Claims, 3 Drawing Sheets

U.S. PATENT DOCUMENTS

| | | | | | |
|---|---|---|---|---|---|
| 3,578,445 | A | * | 5/1971 | Elchisak et al. | 430/56 |
| 3,878,963 | A | * | 4/1975 | Knize | 220/623 |
| 4,085,865 | A | * | 4/1978 | Thompson et al. | 222/1 |
| 4,172,573 | A | * | 10/1979 | Moore et al. | 244/135 R |
| 4,173,290 | A | * | 11/1979 | Kobayashi et al. | 220/678 |
| 4,241,844 | A | * | 12/1980 | Dolveck | 220/620 |
| 4,842,186 | A | * | 6/1989 | Doyle et al. | 228/222 |
| 4,892,214 | A | * | 1/1990 | Hamaguchi et al. | 220/620 |
| 4,997,661 | A | * | 3/1991 | Kromer et al. | 426/126 |
| 5,427,268 | A | * | 6/1995 | Downing et al. | 220/581 |
| 5,503,295 | A | * | 4/1996 | Kotarba et al. | 220/581 |
| 5,595,319 | A | | 1/1997 | Householder et al. | |
| 5,777,343 | A | | 7/1998 | Rasel et al. | |
| 6,012,598 | A | | 1/2000 | Antoniou | |
| RE37,144 | E | * | 4/2001 | Webb | 219/73 |
| 6,499,646 | B1 | | 12/2002 | Jaidka | |
| 6,534,776 | B2 | | 3/2003 | Dougherty et al. | |
| 6,715,668 | B2 | | 4/2004 | Jaidka | |
| 7,032,768 | B2 | * | 4/2006 | Felbaum | 220/582 |
| 2004/0031800 | A1 | * | 2/2004 | Wang | 220/581 |

OTHER PUBLICATIONS

United States Department of Transportation, Pipeline and Hazardous Materials Safety Admin., 49 CFR Part 179—Specifications for Tank Cars, Section 179.300, Subpart E—Specifications for Multi-Unit Tank Car Tanks (Classes DOT-106A and 110AW), Oct. 1, 2007 Edition, pp. 1096-1100.

* cited by examiner

CONTAINER FOR TRANSPORTING AND STORING HAZARDOUS SUBSTANCES AND METHOD FOR MAKING THE CONTAINER

This utility patent application claims priority to U.S. provisional patent application Ser. No. 60/746,820 filed May 9, 2006, which is incorporated herein by reference in its entirety.

TECHNICAL FIELD

The present invention pertains to pressurized transportation vessels, and more particularly to containers for transporting and storing pressurized hazardous materials.

BACKGROUND OF THE INVENTION

Containers used to store toxic or hazardous chemicals are well known in the art. For many years manufacturers and users of various chemical substances have purchased containers to transport and store these substances. Some of the chemicals stored in these containers include chlorine, sulfur dioxide, as well as numerous other chemicals. It is appreciated that while these substances are useful for their intended purpose, in a certain state they may be hazardous if brought into contact with human beings.

One type of container for transporting hazardous substances is the multi-unit tank car. The containers may be sized and configured to store a particular amount of chemical for transportation. Typically the containers of this type are constructed from carbon steel. For safety purposes certain characteristics, such as wall thickness and material type, may be mandated by governmental regulations pertaining to containers for handling hazardous substances. In general, the containers are extremely durable and have a usable life cycle of many years or even decades. Durability is important in ensuring the longevity of storing these substances safely.

As more and more containers are manufactured and as the life cycle of these containers is relatively long, the need for containers of this type may diminish. Therefore, it is important to be able to compete cost effectively in the industry. What is needed is a container for storing hazardous substances and a method for constructing the containers that reduces costs while maintaining the standards to which these containers must be made.

BRIEF SUMMARY

In one embodiment the subject invention includes a vessel and a method of constructing a vessel that includes providing a generally tubular or cylindrical body having an end portion, the end portion having a peripheral lip, providing at least a first end member having a peripheral edge, the first end member having a convex configuration, i.e. convex to the pressure side of the vessel, positioning the peripheral edge of the first end member interior to the peripheral lip of the cylindrical body forming a lap joint, and, welding the peripheral edge of the first end member to the peripheral lip of the cylindrical body.

One aspect of the method of constructing a welded pressure vessel includes positioning the first end member such that the convex portion of the first member is facing interior to the generally cylindrical body.

Another aspect of the method of constructing a welded pressure vessel includes providing a generally cylindrical body having an end portion, the end portion having a peripheral lip and wherein the peripheral lip is angled inward to a centerline axis of the cylindrical body.

Still another aspect of the method of constructing a welded pressure vessel includes fillet welding the lap joint forming an interior weld joint between the cylindrical body and the end member.

Even another aspect of the method of constructing a welded pressure vessel includes providing a generally cylindrical body having an end portion, the end portion having a peripheral lip, wherein the body is constructed from 516 grade 70 carbon steel.

Yet another aspect of the method of constructing a welded pressure vessel includes providing a safety relief valve, and, affixing the safety relief valve to the at least a first end member.

In another embodiment of the present invention, a vessel for containing pressurized material includes a body portion defining an interior region, at least a first end member having a curved portion, wherein the at least a first end member is affixed to the body portion such that the curved portion is convex with respect to the interior region, and wherein the at least a first end member is fusion welded to the body portion and wherein the at least a first end member and the body portion may form a lap joint that is interior with respect to the body portion.

DETAILED DESCRIPTION OF THE INVENTION

Figure 1:
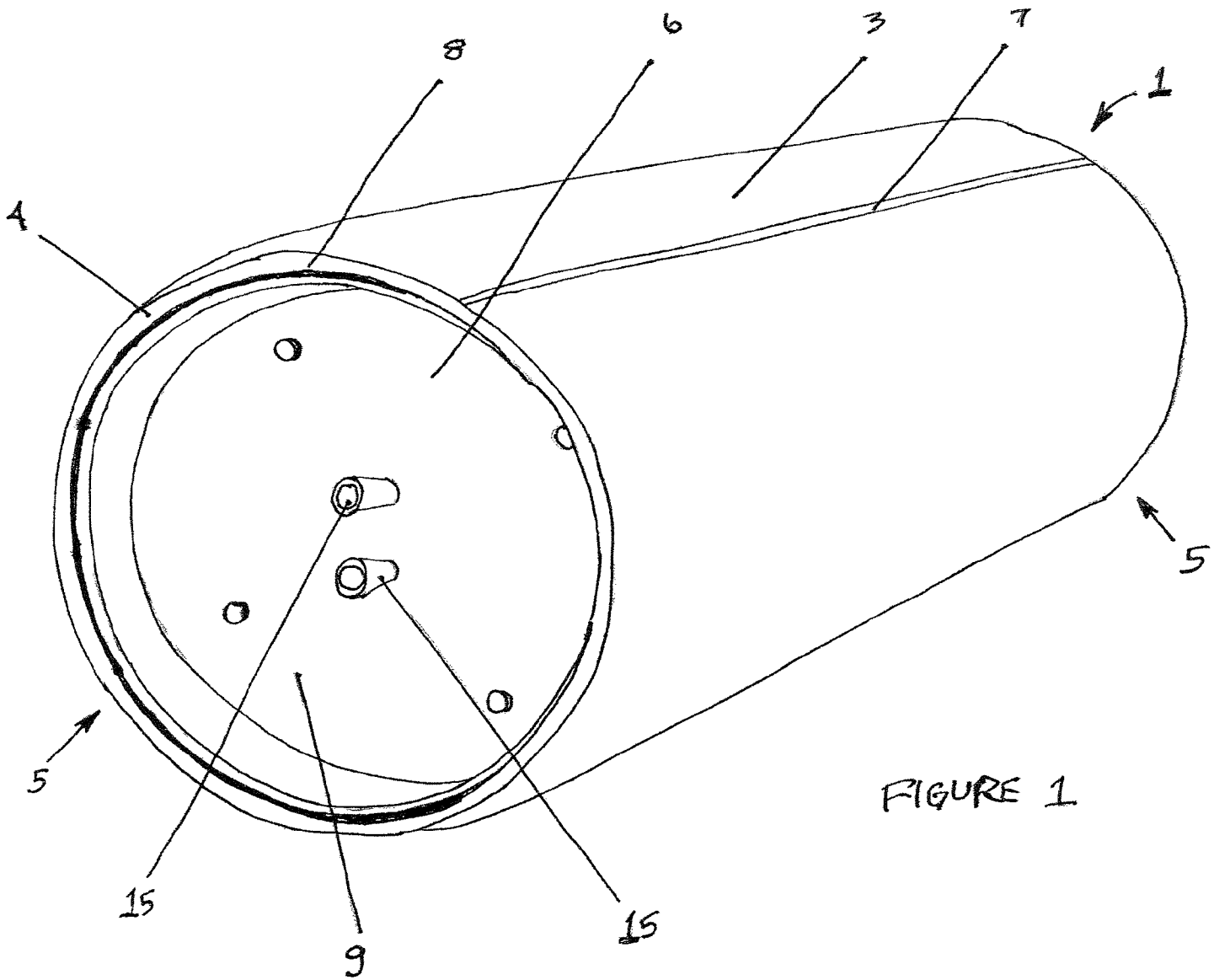
FIG. 1 is a perspective view of container for storing hazardous substances according to the embodiments of the invention.

Referring now to the drawings wherein the showings are for purposes of illustrating embodiments of the invention only and not for purposes of limiting the same, FIG. 1 shows a transportation and/or storage container depicted generally at 1. The container 1 or vessel 1 may be constructed to contain one or more of a plurality of substances. In one embodiment, the substances may be hazardous substances or chemicals such as Chlorine, Sulfur Dioxide or other hazardous materials. Typically, containers of this type have been constructed to contain 2000 pounds of Chlorine. As such, the phrase "Ton Containers" has been coined in referring to containers of this type. The container 1 may be fashioned as a generally cylindrical container as shown in the figures. In this manner, the body 3 or body portion 3 of the storage container 1 may be curved around a central axis X and may have a circular cross section. The container 1 may also include end walls or end members 6. The end members 6 may be affixed to the body 3 such that the container 1 is capable of being pressurized while transporting and storing the hazardous substances. In one embodiment, the end members 1 may be welded to the body 3 as will be discussed further in a subsequent paragraph. Accordingly, the container 1 may also include one or more valves 15, which may be pressure relief valves 15. The valves 15 may be any type of valve as is appropriate for use with the storage of pressurized hazardous materials. The valves 15 may be used to fill and/or empty the container 1 of the contained substances as desired. The valves 15 may also be used as a safety measure to provide pressure relief in the case of over-pressurization. Still, any manner of utilizing the valves 15 may be chosen as is appropriate for use with the embodiments of the subject invention.

With continued reference to FIG. 1, the body 3 or shell may be constructed from sheet steel roll-formed into the straight cylindrical configuration. In one embodiment, the sheet steel may have a minimum thickness of 13/32 inches and have a length of substantially 81½ inches long. When roll-formed, the I.D., i.e. inner diameter, may be 29¼ inches. Additionally, the type of steel utilized in constructing the body 3 may be ASME SA-516 Grade 70 carbon steel. However, other grades of steel may be used that conform to the proper regulatory restrictions including but not limited to Title 49 of the Code of Federal Regulations. Once the steel body 3 has been formed into a cylinder, the seam 7 may be fused together by welding to join the sides of the body 3. In one embodiment, the seam 7 may be fusion welded. More specifically, the welded joint may be a double welded butt joint. After the body 3 has been constructed post welding treatment, such as stress relieving, may also be performed.

Figure 2:
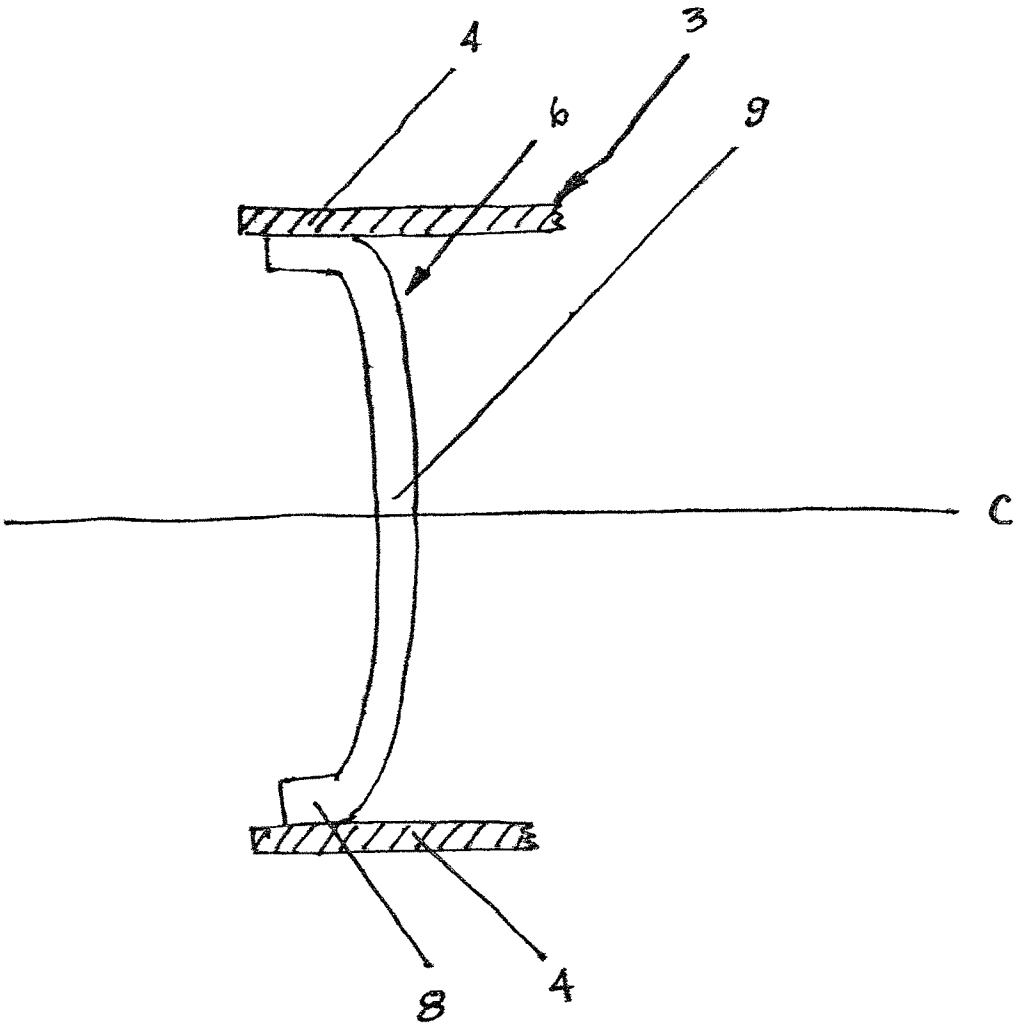
FIG. 2 is a partial cutaway side view showing the components of the container for storing hazardous substances according to the embodiments of the invention.

With continued reference to FIG. 1 and now to FIG. 2, the end members 6 or head may be constructed from the same type of material as that of the body 3, namely SA-516 Grade 70 carbon steel. However, the thickness of the end members 6 may be thicker than the body 3. In one embodiment, the thickness may be approximately 0.7 inches. A minimum thickness may be 11/16 inches. However, any thickness above the minimum thickness may be chosen with sound judgment as is appropriate for use with the embodiments of the subject invention. The end members 6 may be fashioned in the shape of a disk or plate having an outer diameter corresponding to the inner diameter of the body 3. The end members 6, or portions thereof, may be curved. More specifically, the end members 6 may be curved at their respective center portions 9 thereby having a domed shape with a corresponding radius. When positioned in the body 3, the curved portion of the end members 6 may be convex with respect to the interior region of the vessel 1. In other words, the end members 6 may be positioned convex with respect to pressure in the vessel 1. This may be utilized as a safety mechanism for relieving pressure in the container 1. In the case where pressure in the container 1 increases to a particular threshold, the center portion 9 of the end member 6 may invert, such that the center portion 9 becomes concave to pressure. It will be appreciated that the inverted end member 6 increases the overall volume of the container 1 thereby reducing pressure in the container 1. It is noted here that the container 1 may include two end members 6, each one disposed on distal ends of the body 3. Each end member 6 may be inserted convex to pressure or convex to the interior of the container 1. The end members 6 may also include a peripheral edge 8 extending substantially parallel with respect to a center line C of the end members 6. As the end members 6 are generally circular, the O.D., i.e. outer diameter, of the peripheral edge 8 may correspond to I.D. of the body 3.

With continued reference to FIGS. 1 and 2, the end member 6 may be placed inside body 3 such that the peripheral edge 8 is recessed with respect to the peripheral lip 4. In this way, the edge 8 and lip 4 may be juxtaposed to create a lap joint or fillet lap joint configuration. As mentioned above, the end members 6 may be welded, or fusion welded, to the body 3. In particular, the peripheral edge 8 may be welded to the peripheral lip 4 of the body 3. It is noted that the weld joint 11 is fashioned opposite the exterior surface of the body 3. That is to say that the weld joint is in an interior region of the body and is not exposed to external damage, as may occur from impact with another object. The components may be welded using a submerged arc procedure as is appropriate for use with carbon steel materials. However, the lap joint may also be welded using shielded gas welding or any other welding process as chosen with sound engineering judgment.

Figure 3:
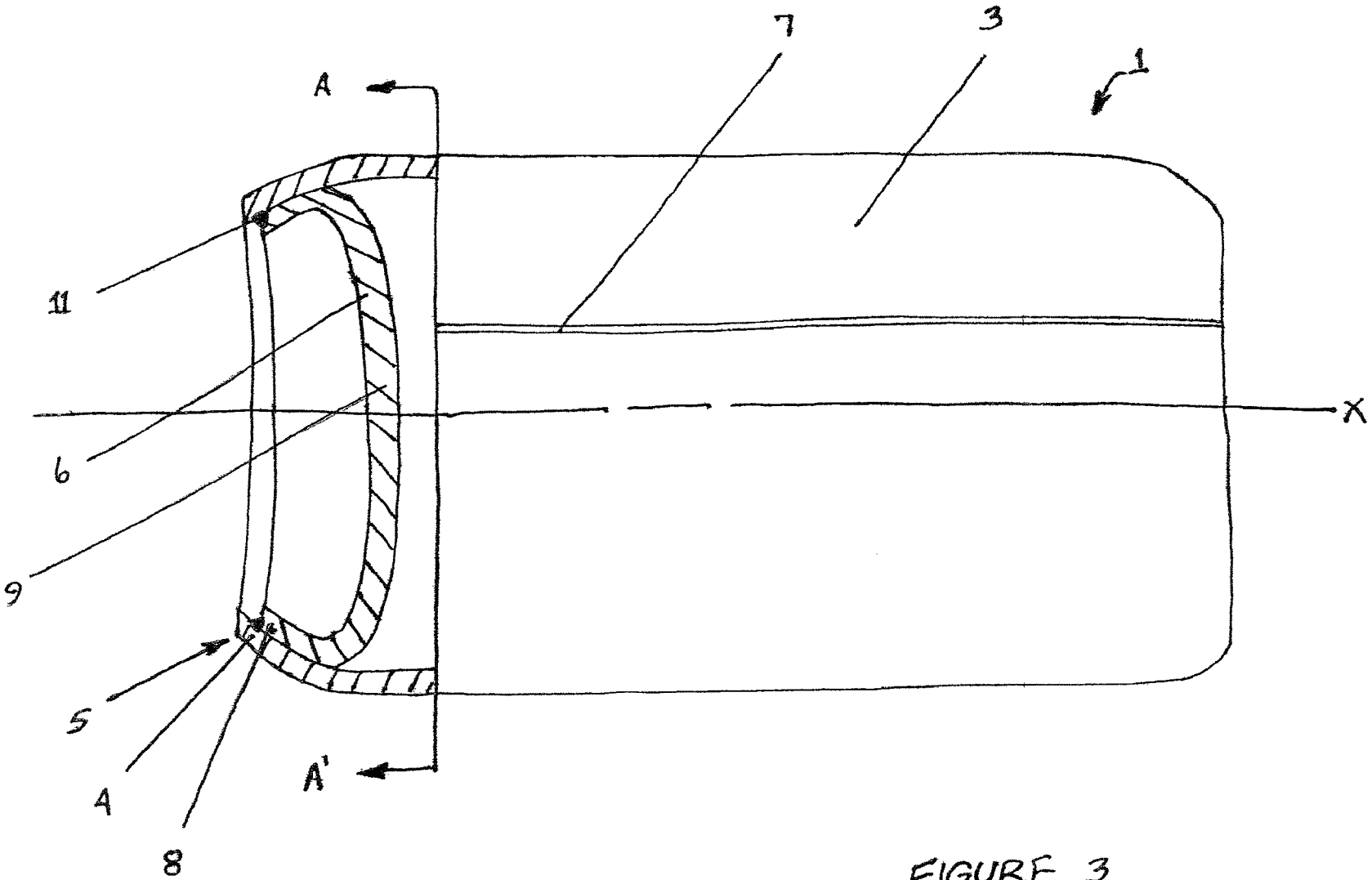
FIG. 3 is a partial cutaway side view of the container for storing hazardous substances according to the embodiments of the invention.

With continued reference to FIG. 2 and now to FIG. 3, after the structural components 3, 6 of the container have been welded together, the ends 5 of the body may be tapered inwardly toward the central axis X in a process known as chiming to further protect the welded joint. It should be realized that the peripheral edge 8 of the end members 6 may be pre-contoured or pre-fashioned at any angle to match the final degree of taper of the ends 5 of the body 3 as is necessary for use in providing a secure weld joint.

With continued reference to all of the FIGURES, a process of constructing a container 3 will now be discussed. The container 3 may be constructed by roll forming planar sheet steel into a straight cylindrical body having openings at distal ends of the body. The longitudinal joint of the cylindrical body may then be welded and stress relieved as necessary. First and second end members each having a convex configuration with respect to the interior of the body may then be inserted into the respective ends of the body. The end members may then be juxtaposed to the lip of the body such that peripheral edge of the end members and the lip form a lap joint, or a fillet lap joint, interior to the body cavity. The joint may then welded sealing the interface of the components, i.e. end members and body, in a manner suitable for pressurization of the container. At any place in the process of constructing the container, holes may be bored in the components of the container and threaded for use in receiving valves, plugs or any other item suitable use in a container storing pressurized and hazardous material.

The invention has been described herein with reference to the preferred embodiment. Obviously, modifications and alterations will occur to others upon a reading and understanding of this specification. It is intended to include all such modifications and alternations in so far as they come within the scope of the appended claims or the equivalence thereof.

We claim:

1. A vessel for containing hazardous pressurized material, comprising:

a generally tubular body portion and at least a first end member defining an interior region containing a lethally-inhaled substance, wherein the generally tubular body portion has first and second ends that are inwardly chimed toward a centerline of the vessel;

wherein the at least a first end member has a domed center portion and substantially uniformly thick walls, wherein the domed center portion is convexly curved with respect to the interior region having a radius of curvature from a center to a circumferential edge of the at least a first end member whereby the at least a first end member is adapted to concavely invert under pressure thereby increasing a volume of the vessel and automatically reducing pressure of the lethally-inhaled substance, wherein the at least a first end member forms a lap weld joint with an interior surface of the generally tubular body portion that is retracted with respect to the first and second ends such that the lap weld joint is formed within the interior region of the generally tubular body portion; and, wherein the at least a first end member is fusion welded to the generally tubular body portion at the lap weld joint.

2. The vessel as defined in claim 1, wherein the body portion is constructed from ASME SA-516 Grade 70 carbon steel.

3. The vessel as defined in claim 2, wherein the body portion has a minimum thickness of about 13/32 inches.

4. The vessel as defined in claim 1, wherein the at least a first end member is constructed from ASME SA-516 Grade 70 carbon steel, and, wherein the at least a first end member has a minimum thickness of about 11/16 inches.

5. The vessel as defined in claim 1, wherein the body portion includes a longitudinal seam, and, wherein the longitudinal seam is fusion welded.

6. The vessel as defined in claim 5, further comprising:

one or more valves for filling the vessel with an associated pressurized material.

7. A method of constructing a vessel for containing hazardous pressurized substances, the steps comprising:

providing a tubular body having an end portion defining an interior region and a peripheral lip;

providing at least a first domed shaped end member having a center portion and a peripheral edge extending transversely from a circumferential edge of the center portion, wherein the at least a first domed shaped end member is curved from a center to a circumferential edge of the at least a first domed shaped end member so that the at least a first domed shaped end member is adapted to invert under pressure for increasing a volume of the vessel and automatically reducing pressure of the hazardous material;

positioning the at least a first domed shaped end member such that the curved portion is convex with respect to the interior region;

recessing the peripheral edge of the at least a first end member with respect to the peripheral lip of the body forming a lap joint thereby forming a lap weld joint within the interior region;

chiming the end portion of the body inwardly toward a centerline axis of the body portion;

pre-forming the peripheral edge of the at least a first domed shaped end member to match the chimed end portion and, welding the peripheral edge of the at least a first end member to an interior surface of the tubular body.

8. The method as defined in claim 7, wherein the step of:

welding the peripheral edge of the at least a first end member to the peripheral lip of the body, comprises the step of:

fillet welding the lap joint of the peripheral edge of the at least a first end member and the peripheral lip of the body thereby forming an interior weld joint between the body and the at least a first end member.

9. The method as defined in claim 7, wherein the step of:

providing a tubular body having an end portion defining a peripheral lip, comprises the step of:

providing a generally cylindrical body having an end portion defining a peripheral lip, wherein the body is constructed from 516 grade 70 carbon steel having a minimum thickness of 13/32 inch.

10. A vessel for containing hazardous pressurized material, comprising:

a roll formed body portion and first and second end members fixedly attached to the roll formed body portion defining an interior region containing a pressurized lethally-inhaled material, wherein the roll formed body portion is constructed from a grade 70 of carbon steel and forms a cylinder having first and second ends that are both inwardly chimed with respect to a centerline axis of roll formed body portion, wherein the roll formed body portion has a minimum wall thickness (T1);

wherein the first and second end members have arched center portions and wall thicknesses (T2) that are approximately 1.7 times the minimum wall thickness (T1), wherein the first and second end members are recessed entirely within the first and second ends of the roll formed body portion respectively, wherein the arched center portions of each of the first and second end members have a constant radius of curvature from the center point to an outer periphery of the first and second end members, wherein the arched center portions are each convex with respect to the interior region thereby defining a first volume (V1) of pressurized material storage, wherein under pressure either or both of the first and second end members invert concavely to define a second larger volume (V2) of pressurized material storage, wherein the first and second end members each include a peripheral edge extending transversely from the outer periphery, wherein the respective peripheral edges of the first and second end members are angled inwardly with respect to a centerline axis of the vessel to match the inwardly chimed first and second ends of the roll formed body portion, wherein the peripheral edges of the first and second end members each form respective lap joints on an interior surface of the roll formed body portion proximal to the first and second ends of the roll formed body portion for protecting the respective lap joints of the first and second end members, and wherein the first and second end members are fusion welded to the roll formed body portion at the respective lap joints.

11. The vessel as defined in claim 10, wherein the pressurized lethally-inhaled material comprises chlorine.

12. The vessel as defined in claim 1, wherein the pressurized lethally-inhaled material comprises chlorine.

13. The vessel as defined in claim 12, wherein the radius of curvature is constant from the center of the at least a first end member to the circumferential edge of the at least a first end member.

* * * * *